US005832578A

United States Patent [19]

Yuda et al.

[11] Patent Number: 5,832,578

[45] Date of Patent: Nov. 10, 1998

[54] METHOD OF MANUFACTURING A FILTER BY FORMING STRIP LINES ON A SUBSTRATE AND DIVIDING THE SUBSTRATE

[75] Inventors: Naoki Yuda, Hirakata; Hiroshi Takahashi, Neyagawa; Takayoshi Ishikawa; Thuyoshi Himori, both of Hirakata; Tomoaki Ieda, Neyagawa, all of Japan

[73] Assignee: Matsushita Electric Industrial Co., Ltd., Osaka, Japan

[21] Appl. No.: 561,860

[22] Filed: Nov. 22, 1995

Related U.S. Application Data

[62] Division of Ser. No. 244,506, filed as PCT/JP93/01467 Oct. 13, 1993, Pat. No. 5,489,881.

[30] Foreign Application Priority Data

Oct. 14, 1992 [JP] Japan ..... 4-275714
Jul. 12, 1993 [JP] Japan ..... 5-171410

[51] Int. Cl.[6] ..... H04R 17/00

[52] U.S. Cl. ..... 29/25.42; 29/25.35

[58] Field of Search ..... 333/203–205, 333/246, 219; 29/25.35, 25.42; 361/303, 306.1, 308.1–308.2, 310, 311–313

[56] References Cited

U.S. PATENT DOCUMENTS

| | | | |
|---|---|---|---|
| 3,457,614 | 7/1969 | Tibol | 29/25.42 |
| 5,248,949 | 9/1993 | Eguchi et al. | 333/204 |
| 5,264,403 | 11/1993 | Abe et al. | 501/139 |
| 5,344,695 | 9/1994 | Hirai et al. . | |

FOREIGN PATENT DOCUMENTS

| | | |
|---|---|---|
| 0506476A1 | 9/1992 | European Pat. Off. . |
| 56-95103 U | 7/1981 | Japan . |
| 56-128705 | 9/1981 | Japan . |
| 59-62201A | 4/1984 | Japan . |
| 61161807 | 7/1986 | Japan . |
| 61-258503 | 11/1986 | Japan . |
| 6243902A | 2/1987 | Japan . |
| 62-164301 | 7/1987 | Japan . |
| 2140931A | 5/1990 | Japan . |
| 371710A | 3/1991 | Japan . |
| 3145803A | 6/1991 | Japan . |
| 3162001A | 7/1991 | Japan . |
| 5-152804A | 6/1993 | Japan . |
| 5243810A | 9/1993 | Japan . |
| 5243812A | 9/1993 | Japan . |
| 5243823A | 9/1993 | Japan . |

*Primary Examiner*—Carl E. Hall
*Assistant Examiner*—Christopher Goins
*Attorney, Agent, or Firm*—Stevens, Davis, Miller & Mosher, L.L.P.

[57] ABSTRACT

The present invention relates to a filter employed in a radio communication apparatus and has as an object to prevent characteristics of the filter from degradation by increasing unloaded Q of strip line resonators of the filter. For achieving the above object, the invention provides a filter which comprises a substrate (4) having first and second strip lines (5), (6) formed on a top surface and mutually coupled through an electromagnetic field and an earth pattern (2) on a bottom surface, respectively, a dielectric layer (8) laminated on the top surface of the substrate and having capacitor patterns (9), (10) formed on a top surface thereof in opposition to the aforementioned first and second strip lines (5), (6), and a metal cap (1) fitted over the dielectric layer (8) having an electrically conductive surface at least on one of top and bottom surfaces, and an electrically conductive film formed on a portion of an outer peripheral surface of the aforementioned substrate (4) and connected to the earth pattern (2) on the bottom surface thereof, wherein at least a portion of an outer periphery of the metal cap (1) in led downwardly toward the electrically conductive film, and the portion led downwardly is connected to the electrically conductive film.

6 Claims, 11 Drawing Sheets

METHOD OF MANUFACTURING A FILTER BY FORMING STRIP LINES ON A SUBSTRATE AND DIVIDING THE SUBSTRATE

This is a division of application Ser. No. 08/244,506, filed as PCT/JP93/01467 Oct. 13, 1993, now U.S. Pat. No. 5,489,881.

TECHNICAL FIELD

The present invention relates to a filter employed in mobile communication apparatuses such as cordless telephones, portable telephones and the like as well as a method of manufacturing the same.

BACKGROUND ART

A structure of this type of filter known heretofore (e.g. from JP-A-03-71710) is shown in FIG. 13 and FIG. 14. In FIG. 13, numerals 70 to 76 denote green sheets of a dielectric material, wherein the green sheets 71 and 72 are provided with electrodes 77, 78, 79, 80 for capacitors. On the other hand, the green sheet 74 is provided with electrodes 81 and 82 for coils, while the green sheet 76 is provided with shielding electrodes 83 and 84. The green sheets 70–76 shown in FIG. 13 are laminated and subsequently fired at such a temperature at which the electrodes 77–84 (e.g. of silver or copper) do not make disappearance, whereby these sheets are integrated in such a structure as shown in FIG. 14. In FIG. 14, numerals 85 and 86 denote input/output terminals. Thus, in the filter known heretofore, capacitors are formed by the electrodes 74–80 disposed in opposition, while coils are formed by the electrodes 81 and 82, wherein the filter is constituted by these capacitors and coils.

A problem of the prior art filter described above is seen in that satisfactory filter characteristics can not be obtained because no-loaded Q of a resonator comprising the capacitor and the coil can not be made high. More specifically, referring to FIG. 13, since the green sheets 70 to 76 are allowed to be fired only at a temperature at which the electrodes 77–84 can not disappear, significant dielectric loss is incurred, as a result of which a constant. indicating low loss of the resonator (no-loaded Q) assumes a small value. Consequently, the filter comprising the resonators each having low unloaded Q suffers significant insertion loss in the pass-band with the characteristic in the attenuation band being damped. Thus, it is impossible to use the filter in such applications in which the requirement for the characteristic requirement is severe.

DISCLOSURE OF INVENTION

Accordingly, it is an object of the present invention to prevent the filter characteristics from degradation by increasing no-loaded Q of the resonator.

For achieving the above object, there is proposed according to the present invention a filter, which comprises a substrate having first and second strip lines formed on a top surface and mutually coupled through an electromagnetic field and an earth pattern on a bottom surface, respectively, a dielectric layer laminated on the top surface of the substrate and having capacitor patterns formed on a top surface thereof in opposition to the aforementioned first and second strip lines, and a cap fitted over and above the dielectric layer and having an electrically conductive surface at least at one of top and bottom surfaces, and an electrically conductive film formed on a portion of an outer peripheral surface of the aforementioned substrate and connected to the earth pattern on the bottom surface, wherein at least a portion of an outer periphery of the cap is led downwardly toward the electrically conductive film so that the portion led downwardly and the electrically conductive film are connected together.

With the structure described above, because the cap is fitted over the dielectric layer with a space therebetween, the electric fields from the first and second strips concentrate in the direction toward the substrate. In this conjunction, as the substrate, there can be used such one which has previously been fired independently at a high temperature. Thus, the dielectric loss can be minimized, as a result of which the unloaded Q of the resonator formed by the first and second strip lines can be made extremely high, whereby the filter characteristics can be protected against degradation.

BEST MODES FOR CARRYING OUT THE INVENTION

In the following, exemplary embodiments of the present invention will be described by reference to the drawings.

(Embodiment 1)

Figure 1:
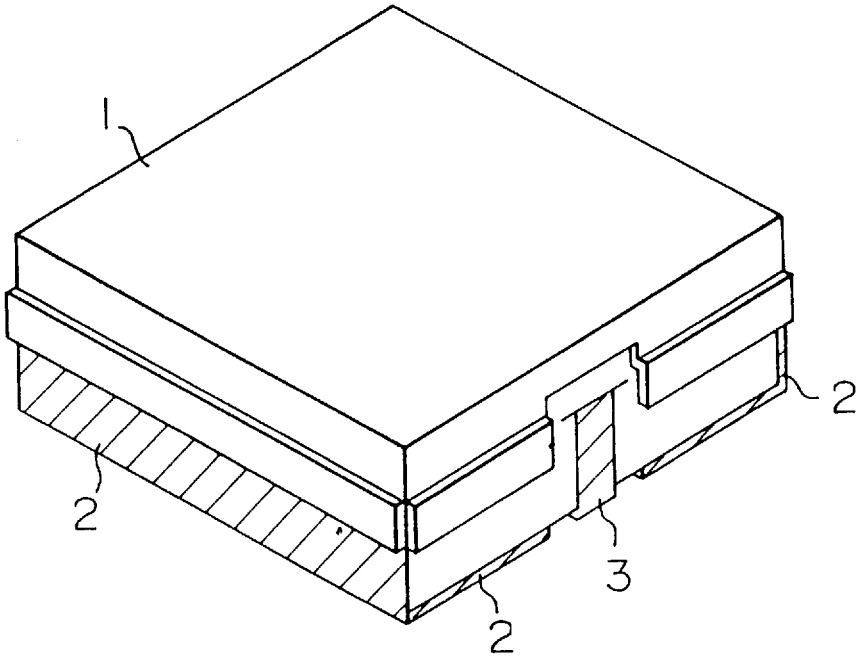
FIG. 1 is a perspective view of a filter according to a first exemplary embodiment of the present invention as viewed from top surface of the filter.
Figure 2:
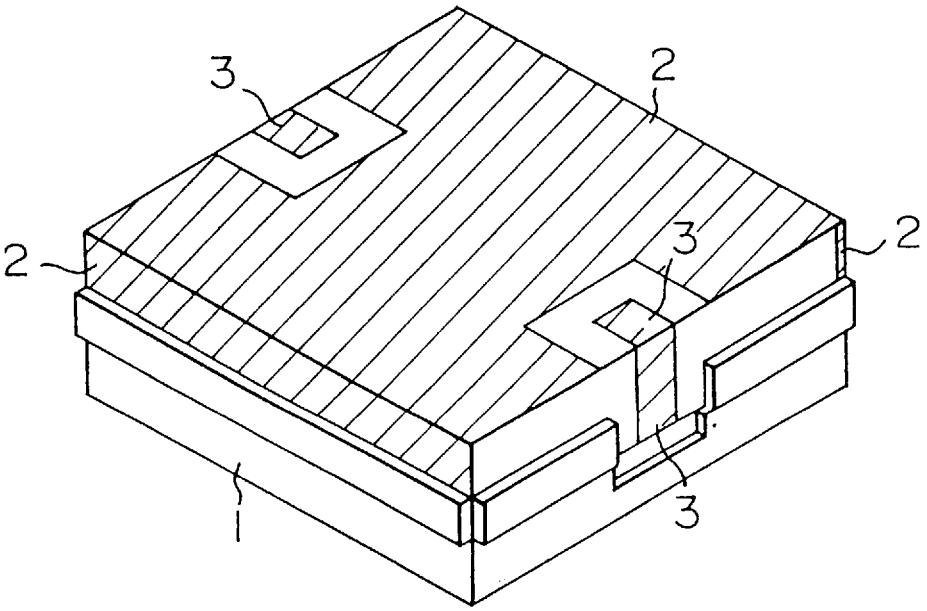
FIG. 2 is a perspective view of the filter according to the first embodiment of the present invention as viewed from a bottom surface thereof.
Figure 3:
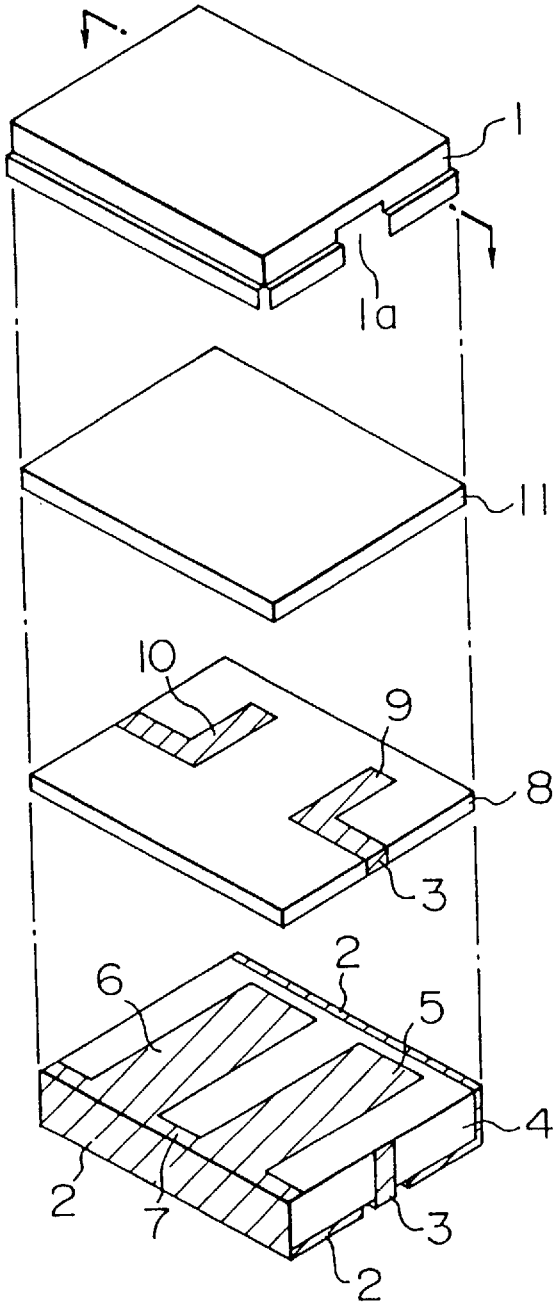
FIG. 3 is an exploded perspective view of the filter according to the first embodiment of the present invention.

FIGS. 1 and 2 are perspective views showing a filter according to the first embodiment of the invention, an viewed from top and bottom sides, respectively. The top surface of the filter is covered with a metal cap 1 while the bottom surface and both of opposite sides are covered with an earth pattern 2. Further, input/output terminals 3 are provided at portions of the bottom surface and the side surfaces which are not provided with the earth pattern. Now, referring to an exploded perspective view of FIG. 3, an internal structure of the filter will be described. In FIG. 3, a numeral 4 denotes a substrate having a dielectric constant of "100", which substrate Is formed by firing, for example porcelain of titanium-oxides series at a high temperature of 1300° to 1400 ° C. On the bottom surface and opposite side surfaces of the substrate 4 are provided with the earth pattern 2 with the input/output terminals 3 being provided at the other opposite aides, wherein first and second strip lines 5 and 6 and a third strip line 7 are provided on the top surface of the substrate. The first and second strip lines 5 and 6 have respective first ends connected to the earth pattern 2 via the third strip line 7, while the other ends of the first and second strip lines 5 and 6 are opened, whereby essentially quarter-wave length resonators are realized. By disposing these resonators in parallel with one another and coupling them through electromagnetic fields, there is implemented a comb line filter. First and second capacitor patterns 9 and 10 are provided on the surface of a first dielectric layer 8 which has a dielectric constant of "10" and is laminated over the surface of the substrate 4. The first and second capacitor patterns 9 and 10 are disposed in opposition to the first and second strip lines 3 and 6, respectively, with the first dielectric layer 8 being interposed therebetween, to thereby constitute capacitors, respectively, wherein the outer peripheral ends of the capacitor patterns are connected to the input/output terminals 3, respectively. A second dielectric layer 11 is laminated over the top surface of the first dielectric layer 8 for protecting the first and second capacitor patterns 9 and 10. The metal cap 1 is mounted on the top surface of the three-layer laminated structure comprising the substrate 4 and the first and second dielectric layers 8 and 11, whereby a filter is completed. Parenthetically, the metal cap 1 is manufactured by forming a oxygen-free copper sheet of 0.2 mm in thickness and having both surfaces plated with silver in a thickness of about 5 $\mu$m into a box-like structure having an open bottom with offset portions being provided at the side surfaces. The top ends of the offset portions bear against the surface of the second dielectric layer 11 for assuring an appropriate height for the cap while lower offset portions are bulged outwardly to cover the side surfaces of the substrate 4. The lower offset portions are soldered to the earth pattern 2 on the side surfaces of the substrate 4 to thereby fixedly secure the metal cap 1 while forming a shield for the exterior. Further formed In the side surfaces of the metal cap 1 are notches 1*a* for preventing the cap 1 from contacting the first and second capacitor patterns 9 and 10 upon mounting of the cap 1. In the structure a high temperature of 1300° to 1400 ° C. as mentioned above, the substrate is in the sintered state of high density which gives rise to only an extremely small dielectric loss. Thus, the resonator can enjoy extremely high unloaded Q.

Figure 4:
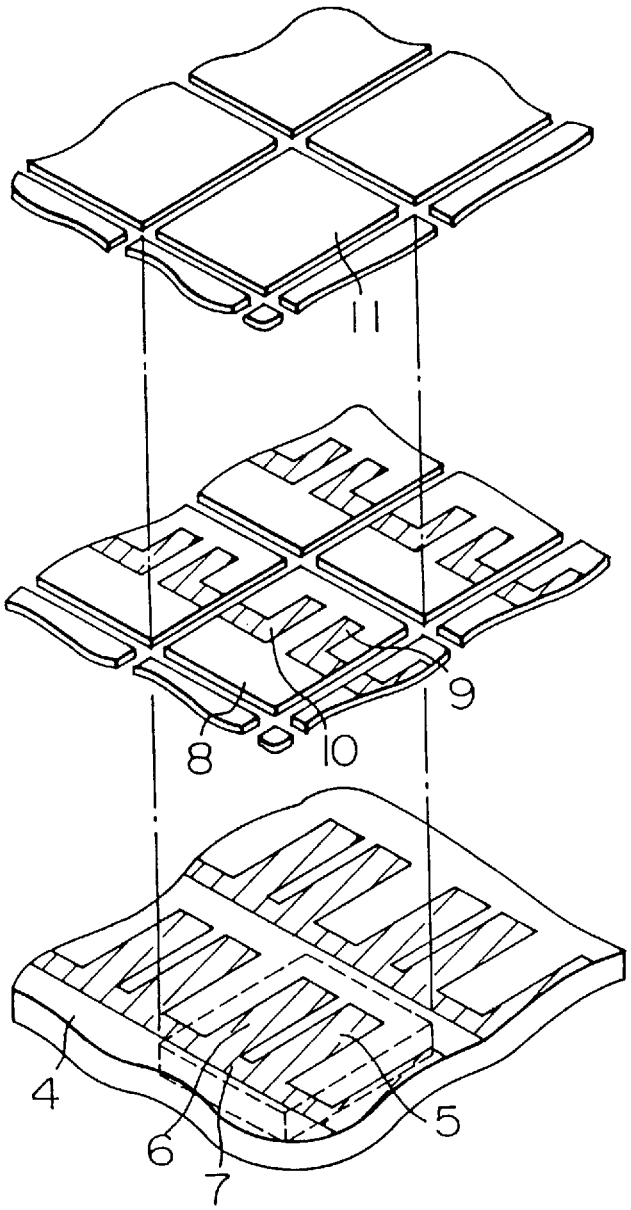
FIG. 4 is an exploded perspective view for illustrating a method of manufacturing a filter according to the first embodiment of the present invention.

Next, description will be directed to a method of manufacturing the filter by referring to FIG. 4. At first, the substrate 4 of a large size fired at a high temperature of 1300° to 1400 ° C. is prepared, whereon the earth pattern 2 and a plurality of input/output terminals 3 are printed on a bottom surface (not shown) of the substrate 4 by using an electrically conductive paste containing silver powder as a main component, and fired at a temperature of 850° to 900 ° C. Subsequently, the first to third strip lines 5, 6 and 7 are printed each in a plurality on the top surface of the substrate 4 by using the electrically conductive paste mentioned above and fired at a temperature of 850° to 900 ° C. In succession, the first dielectric layer 8 is printed by using a dielectric paste prepared by mixing a dielectric powder of barium titanate series and glass of silicon oxide-lead series and fired at a temperature of 850° to 900 ° C. On the surface of the first dielectric layer 8. the first and second capacitor patterns 9 and 10 are printed each in a plurality and fired, an in the case of the strip lines 5 to 7. Additionally, the second dielectric layer 11 is printed and fired, as in the case of the first dielectric layer 8. A laminated structure formed in this manner is cut along broken lines shown in the drawing into individual pieces. Thereafter, on the side surfaces of each piece resulting from the cutting, the earth pattern 2 and the input/output terminals 3, are printed, an shown in FIG. 3, by using the aforementioned electrically conductive paste and fired as described previously. In that case, the third strip line 7 and the first and second capacitor patterns 9 and 10 are connected to the earth pattern 2 and the input/output terminals 3. respectively. Subsequently, the metal cap 1 is fitted above on the top surface of the interim product and soldered to the earth pattern 2 at the side surfaces, whereby the filter shown in FIGS. 1 and 2 is realized. Owing to the manufacturing method described above, there can be obtained the resonator having high unloaded Q by using the substrate 4 fired at a high temperature of 1300° to 1400 ° C. and exhibiting a very low dielectric loss. Because the other constituents are fired at a temperature of 850° to 900 ° C. there arises no possibility of the earth pattern 2, the input/output terminals 3, the strip lines 5 to 7 and the capacitor patterns 9 and 10 being burned away.

Figure 5:
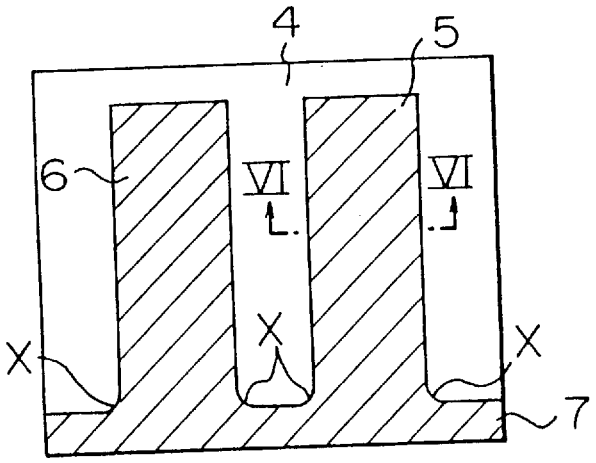
FIG. 5 is a fragmentary enlarged view showing a main portion of a strip line in the filter according to the first embodiment of the present invention.

FIG. 5 is a plan view showing the first strip line 5, the second strip line 6 and the third strip line 7. The first and second strip lines 5 and 6 are structurally adapted to be connected to the earth pattern 2 by way of the third strip line 7. With this structure, the third strip line 7 is cut upon fragmentation into the individual pieces, as shown in FIG. 4, and may undergo dislocation more or less. However, since the first strip line 5 and the second strip line 6 undergo no change in the length, the resonance frequency, the degree of coupling and others are less susceptible to dispersion whereby the filters enjoying the stable or uniform characteristics can be obtained. It is further noted that the first and second strip lines 5 and 6 are bent with the widths thereof being increased at junctions X with the third strip line 7. By virtue of this configuration, concentration of a resonant current to the junction X can be mitigated, whereby the unloaded Q of the resonator can be enhanced. Besides, the blurring of the patterns due to the printing can be suppressed, which contributes to the availability of the resonance frequency stabilized highly.

Figure 6:
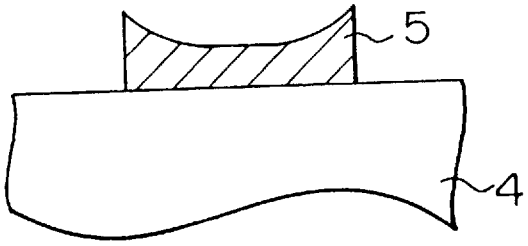
FIG. 6 is an enlarged fragmentally sectional view taken along a line B—B in FIG. 5.

FIG. 6 In a sectional view taken along a line B—B in FIG. 5, wherein the first and second strip lines 5 and 6 are shown representatively by the first strip line 5. When the first and second strip lines 5 and 6 are formed through a conventional printing process, thickness of both ends of the strip line as viewed in the widthwise direction unavoidably tends to decrease, involving excessive thinness. In that case, the resonance current characteristically concentrates to both end portions, as a result of which the electrical conduction characteristic In degraded and incurs deterioration In the unloaded Q of the resonator. For this reason, the thickness of the end portions as viewed in the widthwise direction of the strip line should preferably be made greater than the thickness of the intermediate portion, as shown in FIG. 6. To this end, a mask, for example, having patterns corresponding to only the first and second strip lines 5 and 6 in formed on the substrate 4 and then thick films are deposited inside of the patterns by printing. Thereafter, the mask is burned out. Thus, there can be obtained a strip line having such a form in cross-section an illustrated in FIG. 6.

By virtue of the features described above, the strip line resonator employed in the filter according to the instant embodiment could enjoy unloaded Q of extremely high value not smaller than "200".

Figure 7:
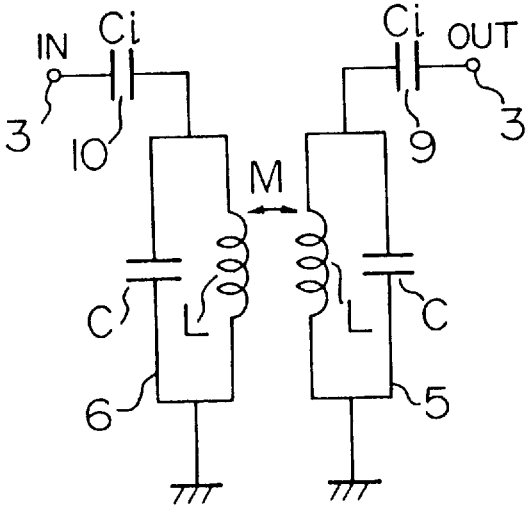
FIG. 7 is an equivalent circuit diagram of the filter according to the first embodiment of the present invention.
Figure 8A:
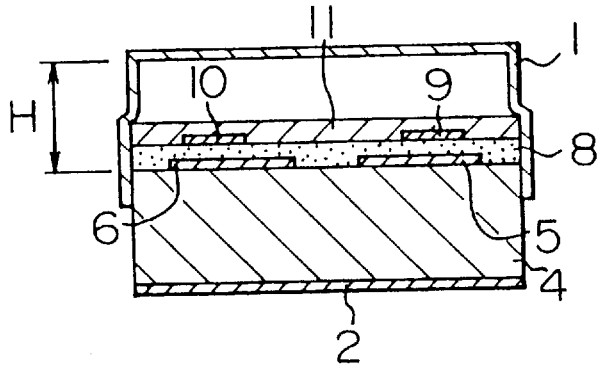
FIG. 8A is a sectional view taken along a line A—A in FIG. 3.
Figure 8B:
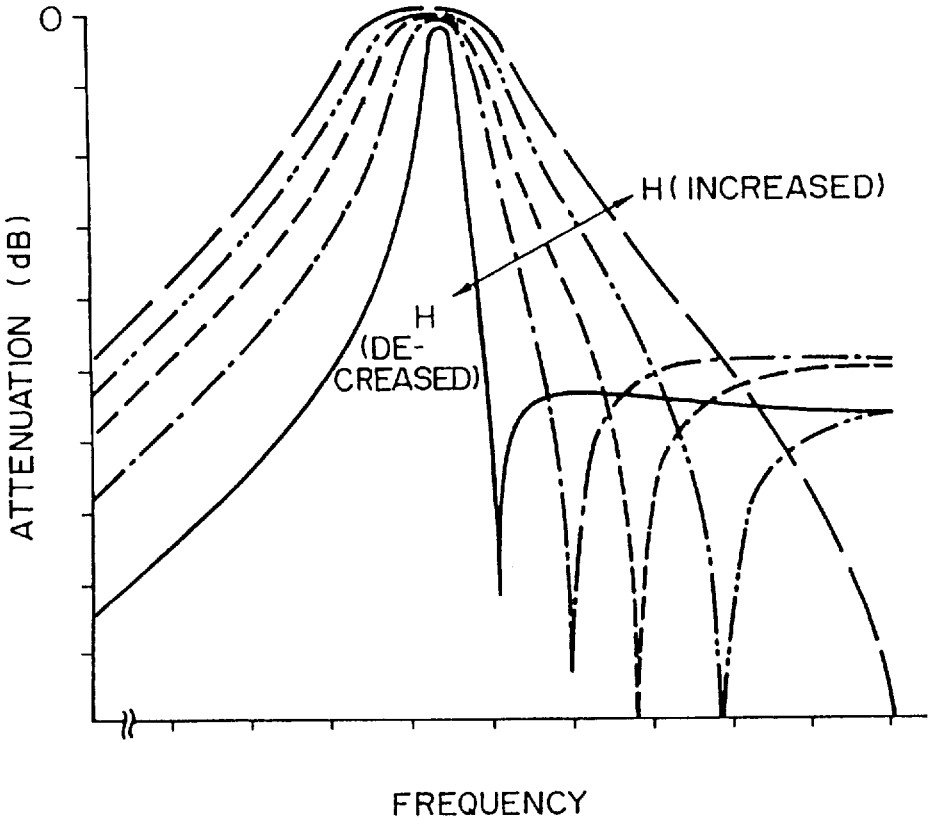
FIG. 8B is a graphical representation illustrating pass characteristics of a filter according to the first embodiment of the present invention.
Figure 9:
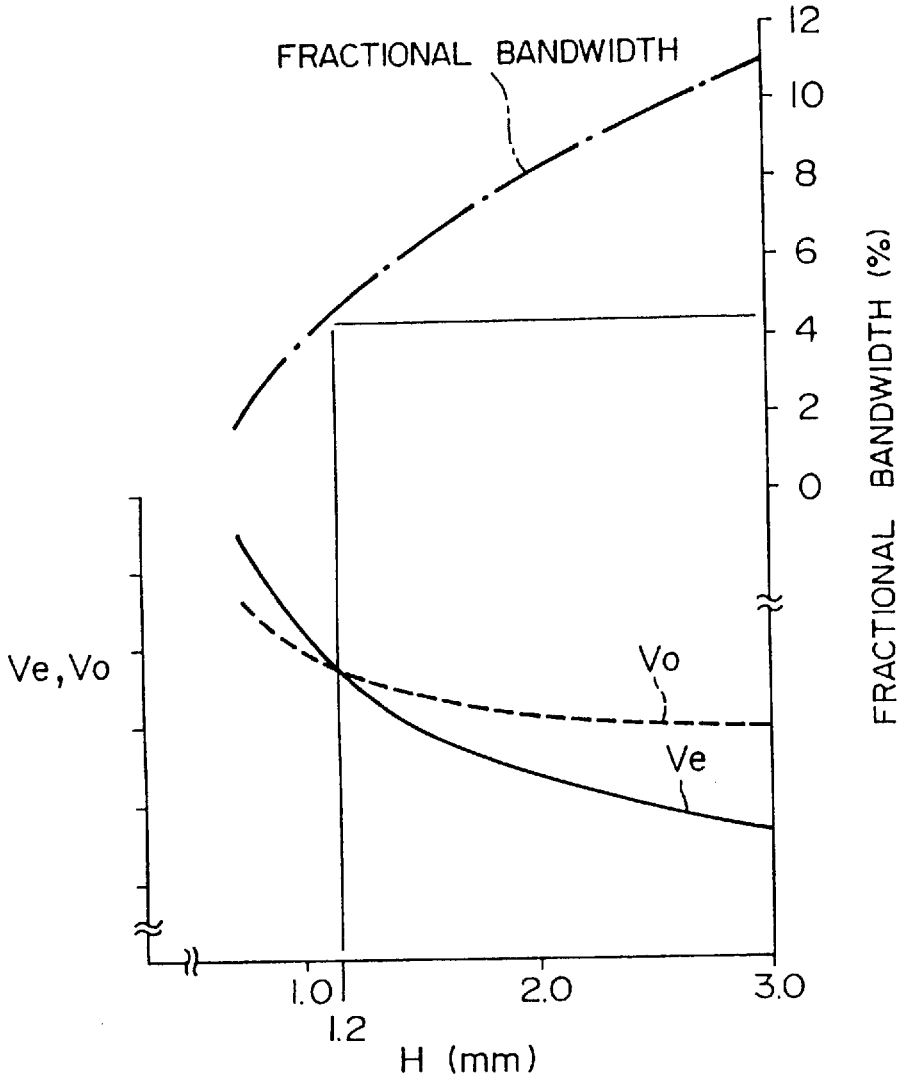
FIG. 9 is a graphical representation showing relations among height of a metal case of the filter according to the first embodiment of the present invention, even/odd mode propagation velocity ratio and a fractional band.

Next, description will be made of operation of this filter. FIG. 7 is an equivalent circuit diagram of the filter now under consideration. Each of the first and second strip lines 5 and 6 constitutes a resonator substantially of quarter wavelength and can be replaced by a parallel resonance circuitry of L and C. In the figure, M represents electromagnetic-field coupling between the two resonators, wherein the frequency band width of a signal passing through the filter is determined by the degree of this coupling. A symbol Ci represents capacitors which are formed by the first and second capacitor patterns 9 and 10 and which serve for matching input impedance of the filter to an external circuit and at the same time bears a role to cut DC components of the signal supplied from the external circuit. Next, description will turn to the passing characteristic of the filter. FIG. 8A a sectional view of the filter shown in FIG. 3 taken along a line A—A, while FIG. 8B shows a characteristic diagram illustrating changes in the filter passing characteristic as a function of change in the height (hereinafter referred to simply as H) from the top surface of the substrate 4 to the top surface of the metal cap 1. As can be seen in FIG. 8B the filter characteristic is such that the hand width decreased as H becomes smaller. The reason for this will be explained below by reference to FIG. 9 which is a view for illustrating change of an even-mode propagation velocity ratio (hereinafter simply represented by Ve), an odd-mode propagation velocity ratio (hereinafter simply represented by Vo) and a fractional band of the filter. An can be seen from FIG. 9, Ve and Vo are equal to each other when H is 1.2 mm. When H exceeds this value, then Ve<Vo and the fractional band-width increases, while when H is smaller than the above value, then Ve>Vo and the fractional band-width decreases. This shows that because the internal electric field distribution varies in dependence on H to thereby bring about corresponding change in the relation between Ve and Vo, the degree of coupling M between the resonators is caused to change. More specifically, as the degree of coupling M becomes large, the fractional band width increases and vice versa.

In general, for a high frequency filter for the mobile communication, extremely narrow band characteristic such that the fractional band width is not greater than 4% is required. With the structure described above, such characteristic can not be realized unless Ve≧Vo. To this end, the height H of the metal cap 1 must be smaller than a height at which Ve equals Vo. In the case of the instant embodiment, the above-mentioned height H was selected to be 1.0 mm, whereby there could be realized the narrow band filter characteristic that the fractional band width is 3.7%, which is suited for the mobile communication.

When the filter of such narrow band is implemented by employing the resonators exhibiting small unloaded Q, insertion loss in the pass band will increase significantly. In contrast, with the structure according to the instant embodiment, there can be made available the resonators whose unloaded Q is not smaller than "200", whereby the resultant filter could enjoy high performance such that the insertion loss is not greater than 1 dB.

(Embodiment 2)

Figure 10:
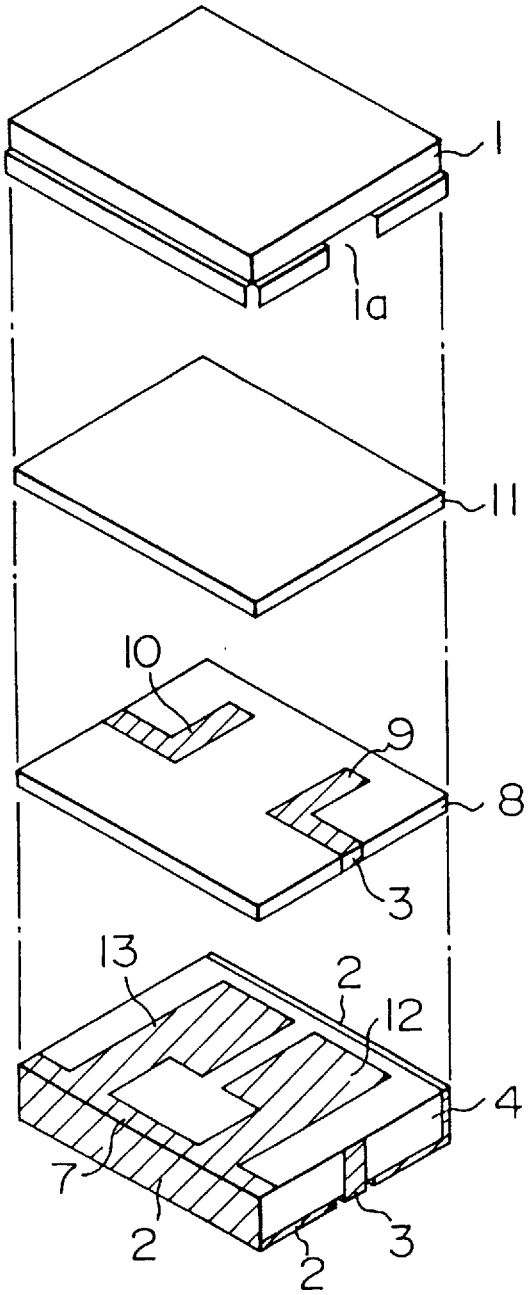
FIG. 10 is an exploded perspective view of a filter according to a second embodiment of the present invention.
Figure 11:
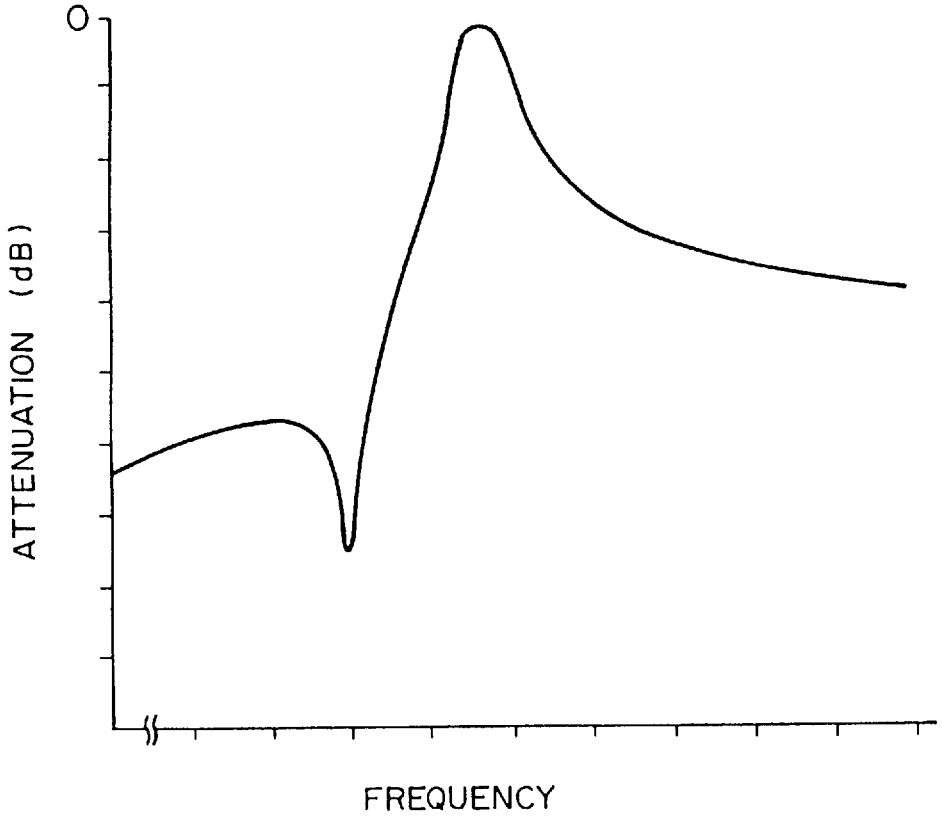
FIG. 11 is a graphical representation of passing characteristic of the filter according to the second embodiment of the present invention.

Next, description will be made of a second embodiment of the present invention. FIG. 10 is an exploded perspective view of a filter according to the second embodiment of the present invention and FIG. 11 is a characteristic diagram illustrating the passing characteristic of this filter. In FIG. 10, a metal cap 1, an earth pattern 2, input/output terminals 3, a substrate 4, a third strip line 7, a first dielectric layer 8, first and second capacitor patterns 9 and 10, and a second dielectric layer 11 are implemented in structures similar to those described hereinbefore by reference to FIG. 3. Difference from the arrangement shown in FIG. 3 is seen in that there are employed first and second strip lines 12 and 13 each having a high impedance portion of a narrow width at one end and a low impedance portion of a large width at the other end, wherein the one and of high impedance in connected to the earth pattern 2 via the third strip line 7 with the other end of low impedance being opened, to thereby realize a resonator. With this arrangement, inductance increases in the high-impedance portion in a relative sense while in the low-impedance portion, capacity increases. Thus, the length of the resonator can be shortened when compared with that having a uniform strip line width. Further, as shown in FIG. 11, by virtue of the passing characteristic of the filter implemented in the aforementioned structure, an attenuation pole can make appearance at a lower frequency in the pass band in dependence on the inter-resonator coupling state. Thus, the filter is suited particularly to applications where magnitude of attenuation at a low frequency in the band is required to be increased.

(Embodiment 3)

Figure 12:
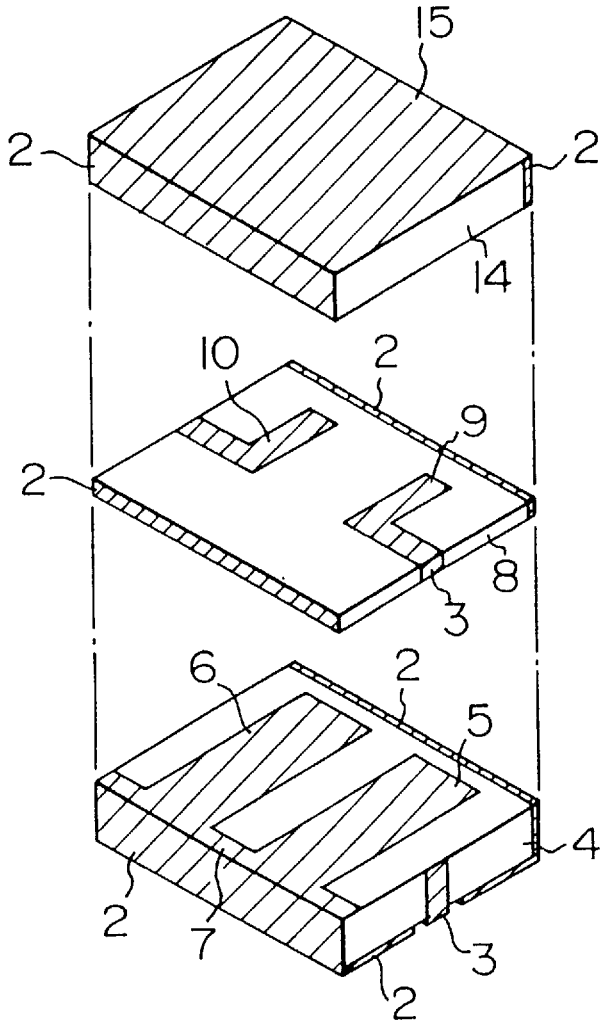
FIG. 12 is an exploded perspective view showing a filter according to a third embodiment of the present invention.
Figure 13:
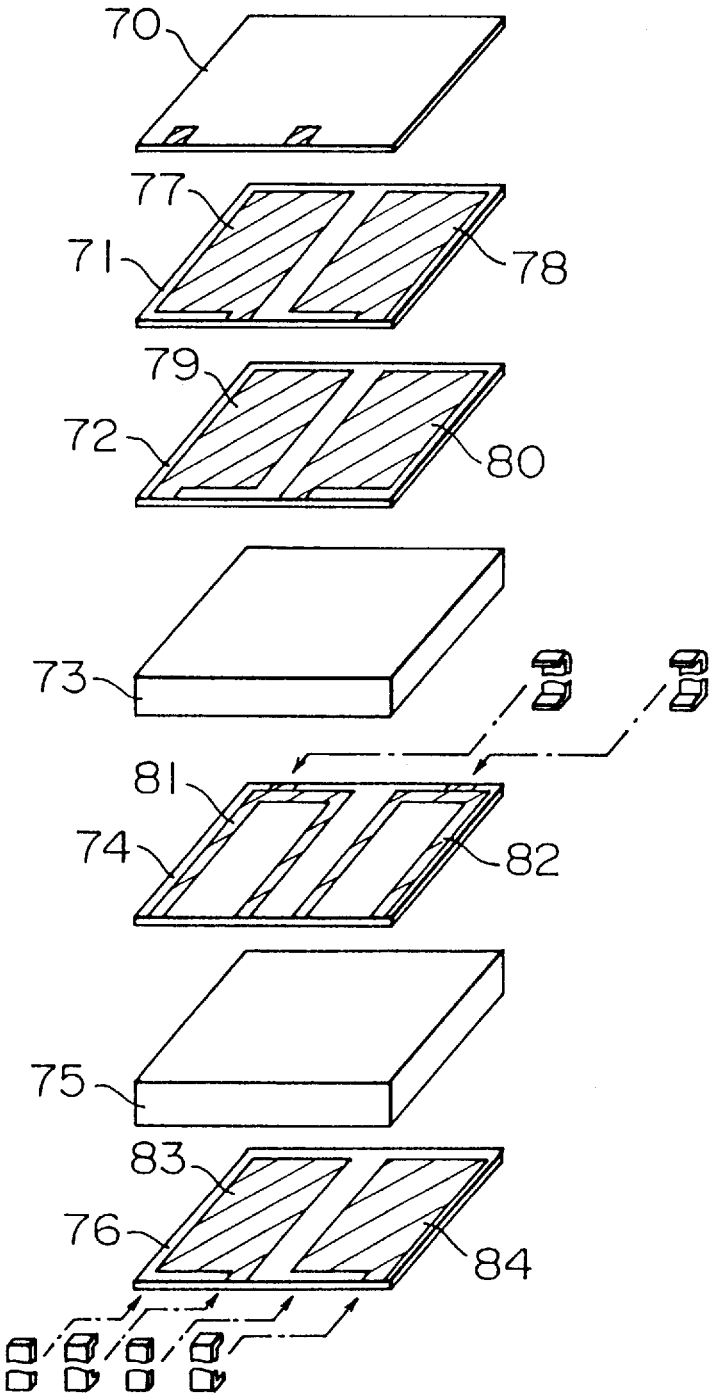
FIG. 13 PRIOR ART
FIG. 13 is an exploded perspective view showing, by way of example, a filter known heretofore.
Figure 14:
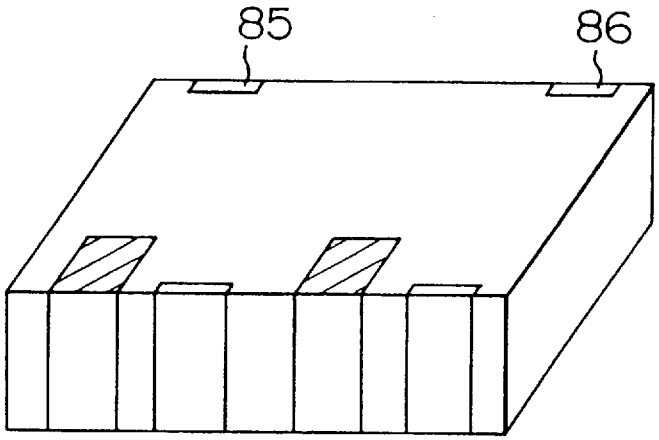
PRIOR ART FIG. 14
FIG. 14 is a perspective view of the hitherto known filter.

Next, description will be directed to a third embodiment of the present invention. FIG. 12 is an exploded perspective view of a filter according to the third embodiment of the invention. In FIG. 12, an earth pattern 2, input/output terminals 3, a substrate 4, first and second strip lines 5 and 6, a third strip line 7, a first dielectric layer 8 and first and second capacitor patterns 9 and 10 are implemented similarly to those shown in FIG. 3. Difference from the arrangement shown in FIG. 3 is seen in that a shield pattern 15 in provided on the top surface of the second dielectric layer 14, wherein the earth pattern 2 formed on the outer peripheral surfaces and the shield pattern 15 are connected to each other, to thereby allow the metal cap 1 to be spared. Further, the method of manufacturing this filter differs from that of the first embodiment in that in succession to lamination of the second dielectric layer 14, the shield pattern 15 is formed on the top surface of the second dielectric layer 14 by printing, which is then followed by cutting into individual pieces, and thereafter the earth pattern 2 and the input/output terminals 3 are provided by printing on the surfaces resulting from the cutting. By virtue of the arrangement described above, all the steps except for the cutting can be realized by printing processes, whereby significant reduction in the manufacturing cost can be achieved. Additionally, the second dielectric layer 14 is so implemented as to have a dielectric constant of "5" which is sufficiently smaller than that of the substrate 4 so that the electric fields from the first and second strip lines 5 and 6 are concentrated to the substrate 4 susceptible to the least dielectric loss, whereby no-loaded Q of the strip-line resonator is made high. In the structure described above, by setting the distance between the shield pattern 15 and the substrate 4 to be not greater than the distance at which Ve becomes equal to Vo, narrow-band characteristics of the filter can be enjoyed as in the case of the first embodiment. Furthermore, by implementing the first and second strip lines 5 and 6 such that high impedance portions of narrow width are formed at first and portions thereof with low impedance portions of large width being formed at the other end portions, respectively, the length of the resonator can be shortened while the attenuation pole can make appearance at a lower frequency side of the band, as in the case of the second embodiment.

Parenthetically, it should be mentioned that in the first, second and third embodiments described above, the frequency adjustment is performed by trimming the earth pattern 2 provided at the outer peripheral surface of the substrate 4. The earth pattern on the outer peripheral surface is formed for the purpose of connecting the metal cap 1 or the shield pattern 15 to the earth pattern 2 on the bottom surface of the substrate 4. By positively making use of the earth pattern 2, the frequency adjustment can be realized. More specifically, by trimming the earth pattern 2 at one and of both of the first and second strip lines 5, 6, 12 and 13 (i.e., at the side of the third strip line 7), inductance increases in this region, whereby the resonance frequency can be lowered. On the contrary, by trimming the earth pattern 2 at the other and, the open-end capacity between that other end and the earth pattern 2 can be decreased, whereby the resonance frequency can be increased. Besides, when the other and portion is trimmed, the earth pattern 2 in this region functions as inductance, whereby an LC series resonance circuit can be formed in cooperation with the open-end capacity. As a result of this, an attenuation pole newly makes appearance at the resonance frequency of the LC resonance circuit, ensuring thus excellent attenuation characteristic.

INNUSTRIAL APPLICABILITY

As in apparent from the foregoing, there has been provided according to the present invention a filter which includes a substrate having first and second strip lines formed on a top surface and mutually coupled through an electromagnetic field and an earth pattern on a bottom surface, respectively, a dielectric layer laminated on the top surface of the substrate and having capacitor patterns formed on a top surface thereof in opposition to the first and second strip lines, and a cap fitted from the above of the dielectric layer and having an electrically conductive layer formed at least on one of top and bottom surfaces thereof, an electrically conductive film formed on a portion of an outer peripheral surface of the substrate and connected to the earth pattern formed on the bottom surface of the substrate, wherein at least a part of an outer peripheral portion of the cap is led downwardly toward the electrically conductive film so that the portion led downwardly and the electrically conductive film are connected together.

with the structure described above, a space is provided above the dielectric layer and covered with the cap. In consequence, electric fields from the first and second strip lines are concentrated in the direction toward the substrate. However, since the substrate can previously be prepared by firing it at a high temperature in the independent state, it is possible to decrease the dielectric loss. As a result of this, no-loaded Q of the resonators formed by the first and second strip lines can be made extremely high, to thereby prevent the filter characteristic from degradation.

We claim:

1. A method of manufacturing a filter, the method comprising:

(a) sintering a substrate at a high temperature;

(b) after the substrate has been sintered at the high temperature in step (a), forming a plurality of first and second strip lines on the substrate;

(c) forming a first dielectric layer on a top surface of the substrate;

(d) forming a plurality of capacitor patterns on a top surface of said first dielectric layer in opposition to said plurality of first and second strip lines;

(e) dividing said substrate into pieces each of a size sufficiently large for accommodating one of each of said first and second strip lines, so as to form exposed surfaces on the substrate;

(f) forming a plurality of electrically conductive films on at least some of the exposed surfaces of the substrate formed in step (e); and (g) fitting a cap above the top surface of the substrate such that an outer peripheral portion of said cap is connected to said plurality of electrically conductive films;

wherein each of steps (b), (c), (d) and (f) comprises firing at a second temperature which is below the high temperature.

2. A method as in claim 1, wherein:

the high temperature is in a range of 1300° to 1400 ° C.; and the second temperature is in a range of 850° to 900 ° C.

3. A method as in claim 1, wherein each of steps (b), (d) and (f) is carried out by a printing process.

4. A method as in claim 1, wherein steps (a)–(g) are performed successively.

5. A method as in claim 1, wherein step (a) comprises forming the substrate by firing porcelain of a titanium-oxide series at the high temperature.

6. A method as in claim 1, wherein step (g) comprises fitting the cap such that the filter has an empty space between the substrate and the cap.

* * * * *